US008894461B2

(12) United States Patent
Horovitz

(10) Patent No.: US 8,894,461 B2
(45) Date of Patent: Nov. 25, 2014

(54) SYSTEM AND METHOD FOR INTERACTIVE TOYS BASED ON RECOGNITION AND TRACKING OF PRE-PROGRAMMED ACCESSORIES

(75) Inventor: Ronen Horovitz, Haifa (IL)

(73) Assignee: Eyecue Vision Technologies Ltd., Yokneam (IL)

( * ) Notice: Subject to any disclaimer, the term of this patent is extended or adjusted under 35 U.S.C. 154(b) by 1253 days.

(21) Appl. No.: 12/582,015

(22) Filed: Oct. 20, 2009

(65) Prior Publication Data

US 2010/0099493 A1 Apr. 22, 2010

Related U.S. Application Data

(60) Provisional application No. 61/106,755, filed on Oct. 20, 2008.

(51) Int. Cl.

| | |
|---|---|
| ***A63H 33/00*** | (2006.01) |
| *A63F 9/24* | (2006.01) |
| *A63F 9/00* | (2006.01) |

(52) U.S. Cl.

CPC ..... *A63H 33/00* (2013.01); *A63F 2009/2419* (2013.01); *A63F 2250/287* (2013.01); *A63H 2200/00* (2013.01); *A63F 2009/0007* (2013.01)

USPC ..... 446/175; 446/441; 446/444; 446/484

(58) Field of Classification Search

CPC ..... A63H 17/32; A63H 17/30; A63H 18/16; A63H 33/00; A63H 33/22; A63H 30/04; A63H 13/10

USPC ..... 446/175, 454–456

See application file for complete search history.

(56) References Cited

U.S. PATENT DOCUMENTS

| | | | | |
|---|---|---|---|---|
| 5,481,257 | A | 1/1996 | Brubaker et al. | |
| 6,456,728 | B1 | 9/2002 | Doi et al. | |
| 6,695,668 | B2 * | 2/2004 | Donahue et al. | 446/175 |
| 7,042,440 | B2 | 5/2006 | Pryor et al. | |
| 7,097,532 | B1 * | 8/2006 | Rolicki et al. | 446/175 |
| 7,261,612 | B1 * | 8/2007 | Hannigan et al. | 446/175 |
| 7,428,994 | B1 * | 9/2008 | Jeffway et al. | 235/454 |
| 7,515,734 | B2 | 4/2009 | Horovitz et al. | |
| 7,758,399 | B2 * | 7/2010 | Weiss et al. | 446/175 |
| 2002/0102910 | A1 * | 8/2002 | Donahue et al. | 446/465 |
| 2004/0214642 | A1 * | 10/2004 | Beck | 463/40 |
| 2004/0229696 | A1 * | 11/2004 | Beck | 463/40 |
| 2006/0234602 | A1 * | 10/2006 | Palmquist | 446/297 |
| 2008/0260244 | A1 | 10/2008 | Kaftory et al. | |
| 2010/0203933 | A1 * | 8/2010 | Eyzaguirre et al. | 463/2 |

FOREIGN PATENT DOCUMENTS

| | | |
|---|---|---|
| WO | WO2008/139482 | 11/2008 |
| WO | WO2008/152644 | 12/2008 |
| WO | WO2009/007978 | 1/2009 |

* cited by examiner

*Primary Examiner* — William M Brewster
*Assistant Examiner* — Alex F. R. P. Rada, II
(74) *Attorney, Agent, or Firm* — Pearl Cohen Zedek Latzer Baratz LLP

(57) ABSTRACT

A system and method for interactive play that includes an object having a visible characteristic such as a color pattern that is recognizable in an image. The color pattern may be associated with an instruction. An imager in a toy captures an image of the object that is processed by a processor in the toy. The processor identifies the visible characteristic and finds the instruction associated with the visible characteristic. The processor may signal an output device of the toy to take an action in accordance with the instruction.

9 Claims, 3 Drawing Sheets

SYSTEM AND METHOD FOR INTERACTIVE TOYS BASED ON RECOGNITION AND TRACKING OF PRE-PROGRAMMED ACCESSORIES

CROSS REFERENCE TO RELATED APPLICATION

This application claims the benefit of U.S. Provisional Application No. 61/106,755, filed on Oct. 20, 2008 entitled "SYSTEM AND METHOD FOR INTERACTIVE GAMES AND TOYS ON EMBEDDED SYSTEMS", incorporated by reference herein.

FIELD OF THE INVENTION

The invention pertains generally to interactive games. More specifically, the invention relates to toys that recognize visible characteristics of objects, and execute instructions associated with such recognized visible characteristics.

DESCRIPTION OF PRIOR ART

Many toys and games seek to increase the level of interaction between a child and the toy by making the toy more responsive to the actions of the child, and by getting the child to respond to the actions or instructions of the toy. Some toys respond to a touch or sound made by a child in the course of play, but existing toys do not recognize and act upon visible stimulus created by a child during play.

SUMMARY OF THE INVENTION

Some embodiments of the invention may include a system for interactive toys having an object with a visible characteristic such as a color code or series or pattern of colors that have a specific visible order or characteristic and that have a predefined association to an instruction from among a set of instructions. The system may also include a housing for a toy, such as a toy car or doll, where the housing has or is connected to an imager suitable to capture an image where the image includes the object with the visible characteristic, a memory to store the instruction that is associated with the particular visible characteristic, and an output device that is suitable to output a response associated with the instruction. The housing may also include or be connected with a processor that may detect the object in the captured image, identify or find in the memory the instruction that is associated with the visible characteristic, and issue a signal to the output device to execute the response in accordance with the instruction.

In some embodiments, the visible characteristic may include a repeating pattern of the visible characteristic.

In some embodiments, the output device may alter a location of the housing or of an appendage of the housing, or may make a noise from for example a speaker, as part of a response that is associated with an instruction.

In some embodiments, the housing may include a receiver that can accept a signal to alter an instruction this associated with the visible characteristic.

In some embodiments, the visible characteristic may be printed on paper or another medium that may be attached to and removed from an object.

In some embodiments, a toy car that includes the housing may change a direction of its locomotion in response to the instruction. In some embodiments, an object having a visible characteristic may be worn by a player and the imager may capture an image of the player with the object and measure a change in a position of the object in a series of images.

Some embodiments of the invention may include a method of interactive gaming that includes affixing a visible characteristic to an object, capturing an image of the visible characteristic with an imager included in a housing of a toy; associating the visible characteristic in the image with an instruction stored in a memory included in the housing; and issuing a signal from a processor included in the housing to activate an output device included in the housing to perform a physical action in accordance with the instruction.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
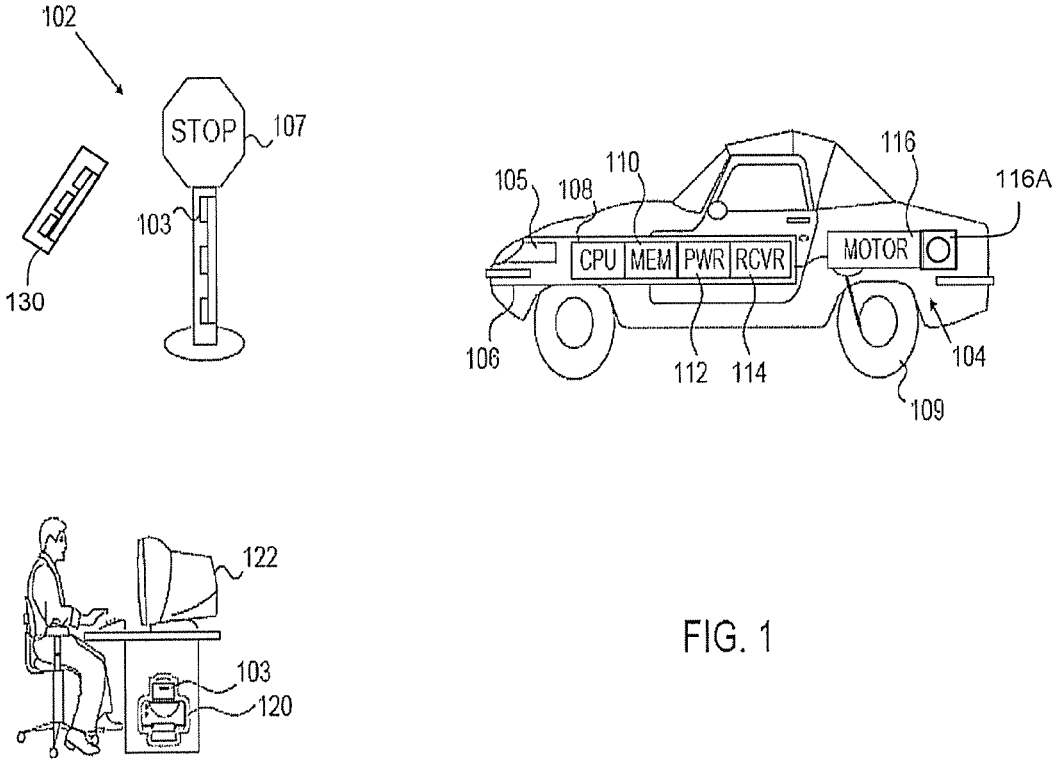
FIG. 1 is a schematic diagram of a system in accordance with an embodiment of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PREFERRED EMBODIMENTS

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention. In this application, the term 'toy' may in addition to its regular meaning, also mean a recreational object such as a physical object or system used in the course of exercise, entertainment or education. Examples may include but not be limited to dolls, toy vehicles, prank props, teaching aids, exercise equipment, board games, stuffed animals and many others.

Reference is made to FIG. 1, a schematic diagram of a system in accordance with an embodiment of the invention. System 100 may include an object 102 such as an accessory for a toy that has a visible characteristic 103 appearing on such object 102 that may be brought into the field of play and of view of a toy 104. Toy 104 may include a housing 106 such as a body of toy 104 or a portion of appendage of toy 104, such as wheel 109, or in the case of a doll, an arm or leg of the doll. Housing 106 may include an imager 105, a processor 108, a memory 110 associated with processor 108, a power source 112 such as a battery that may power one or more of the components of toy 104 and of housing 106, a receiver 114 and one or more output devices 116 that may accept a signal from for example processor 108 to take some action.

In operation, object 102, such as for example a toy road sign, may be affixed with a red stop design (e.g. using a sticker) or with some other visible characteristic such as a color code that is affixed to the pole of the stop sign or other visible characteristic 103. Imager 105, that may be built into or fitted onto a toy car or other housing 106, may capture a video stream or series of images of a field of play, such as a room or playground and one of such images may include the object 102 and the visible characteristic 103 attached to it. One or more of the series of images of the field of play may be processed by processor 108, which may detect the presence of the recognized visible characteristic 103. The recognition of the visible characteristic 103 may trigger processor 108 to look up the visible characteristic 103 in memory 110 and the association in memory 110 of the visible characteristic 103 with an instruction, to identify the proper instruction or commands. Processor 108 may associate the visible characteristic with the instruction. When used herein, "instruction" may include for example, a set of machine-readable instructions (e.g., software) which, when executed by a processor, cause the processor to take certain actions. Instruction may also mean an instruction to cause processor to execute certain routines, or send certain signals (e.g., signals to an output device). Processor 108 may issue a signal to an output device 116, such as a motor in the toy 104 car, to stop once the stop sign is detected in the image.

In some embodiments, an output device 116 may include a horn, light, signal indicator of a toy 104 car, an arm, leg, eye, or other appendage or action of a toy doll, or any combination of movements or actions that may be taken by a toy upon the issuance to such appendage or device of a signal from a processor 108 in accordance with an instruction associated with a visible characteristic 103. In some embodiments, a series of instructions may be included in one or more visible characteristics 103, and a toy 104 may be programmed to take a series of actions in response to the series of instructions recognized as associated with the series of visible characteristics.

When used herein, an "instruction" associated with a visible characteristic 103 may include a set or sequence of instructions (e.g., a software routine) which, when executed by a processor, causes the toy 104 to take a certain action or series of actions.

In some embodiments, size, focus or clarity of the detected visible characteristic 103 in the captured image may be used as an indicator of the proximity of the object 102 to the housing 106. Similarly, the detection of the object 102 in a quadrant or designated area of the image may also be used as a criteria for processor's 108 issuance of a signal to output device 116, so that the signal is only issued when for example the housing 106 or car is for example, close to and to directly in front of the stop sign.

In some embodiments, housing 106 may include a receiver 114, such as a wireless receiver or for example a universal serial bus (USB) or a plug-in acceptor of data from an external source, that may accept a signal that associates, or alters an association of an instruction with a particular visible characteristic 103, alters an instruction, or adds to the sets of visible characteristics 103 and instructions stored in memory 110. A user may through such receiver 114 re-program or customize his own set of instructions that may be activated by his own customized set of visible characteristics 103 to issue signals to an output device 116 to make a customized action or response to the presence of the visible characteristic 103 in the image. A user may instruct a printer to print or create visible characteristics 103 on for example paper or a sticker, which may then be attached to an object and associated with an instruction.

In some embodiments, imager 105 may be or include a CMOS sensor or CCD sensor that may operate on visible light or near IR light. Other still, video or non-visible light imagers or sensors may be used.

In some embodiments, housing 106 may be, include or be included in any suitable toy 104 or device such as a doll, pillow, ball, action figure, punching bag, block or book. In some embodiments, housing 106 may be mounted inside the toy 104 as part of the toy's design. For example, for a plush doll, it can be placed in one or more of its body parts, like its nose, belly, foot or head. In some embodiments, the components listed in this application as being part of housing 106 may be spread among various locations within a toy 104 which may then be considered a housing 106. For example the camera or imager 105 may be mounted in a way that will not affect the design of a doll. Other components such as a power source 112 or processor 108 may be located elsewhere in the toy 104 or housing 106.

Output device 116 may include a motor, visible display, speaker 116A, actuator, or other mechanical element that will give the toy the freedom to move or assume different positions, that may serve as a response to the recognition of visual characteristics 103, and that may create a perceptible change in or relating to the toy 104 or to the user in relation to the toy 104. For example, a speaker in a toy dog may announce that the dog is hungry when an imager in the toy dog detects the presence of a toy food bowl that has a visible characteristic 103 that is recognized by the imager 105 and that is associated with an announcement relating to being hungry. A display screen in a toy doll may brighten the eyes of the toy doll when imager 105 in a housing 106 of the doll detects the proximity of an object 102 such as a doll blanket having a defined visible characteristic 103.

In some embodiments, processor 108 may be or include for example an embedded central processor unit (CPU) such as those used in mobile phones or other embedded systems or electronic devices. Processor 108 may include digital image processing software that may be suitable to for example accept a stream or series of images from imager 105, and buffer the series of images to detect differences in a position or presence of a visible characteristic 103, and to allow execution of computer vision algorithms. Processor 108 may also control or issue signals to output device 116 to control the toy's 104 feedback and interactions with the user by triggering audio, visual or mechanical feedback.

Memory 110 may include one or more mass data storage units that may store a series of instructions, a series of visible characteristics 103 and associations between particular instructions and particular visible characteristics 103. Such instructions and signals may be stored in ROM, flash or other suitable memory units. Instructions and visible characteristics may also be dynamically loaded into memory 110 by way of receiver 114 from for example an external flash memory card or other storage medium that may be programmed by a user on a separate computer 122 and then inserted into the housing 106.

Figure 3A:
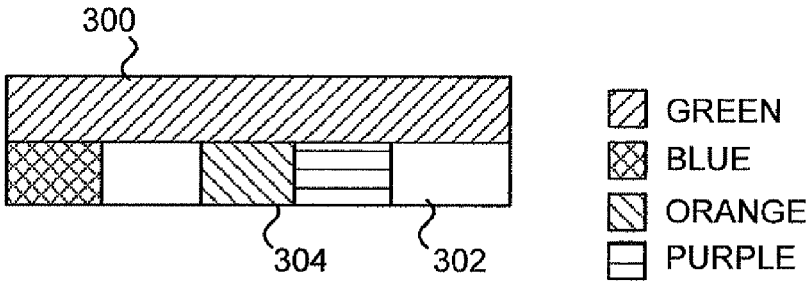
FIGS. 3A, 3B and 3C are examples of visible characteristics as alternating light and dark areas or colored areas, in accordance with an embodiment of the invention.
Figure 3B:
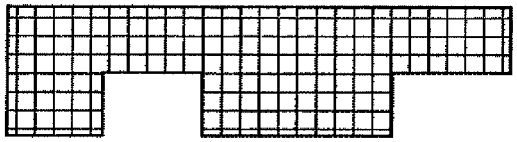
Figure 3C:
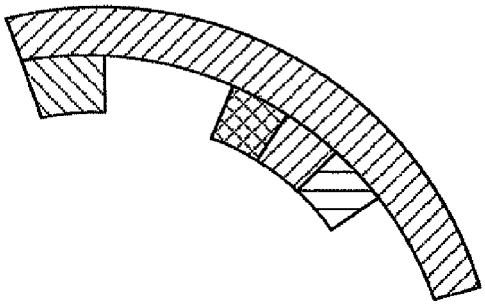

Reference is made to FIGS. 3A, 3B and 3C, examples of visible characteristics as alternating light and dark areas or colored areas, in accordance with an embodiment of the invention. Other visible characteristics may be used. In FIG. 3A, a visible characteristic may take the form of for example a key or an alignment bar 300, and first colored spaces 304, interspersed with light, white or second color spaces 302. In some embodiments, the height and spacing of the alignment bars and color spaces may be from 3 mm to 5 mm as is shown in the FIG. 3A. In FIG. 3B, a monochromatic color code may be printed as a sticker or paper card and affixed to one or more of a series of objects. In FIG. 3C, a curved visible characteristic may be affixed to for example a toy road sign or flash card to add an aesthetic frame to for example a character or symbol on the sign or flash card. Visible characteristics 103 may combine different features extracted from an image, including for example color/spectral features, shape, spatial features, motion features or a combination of all of some of such or other features. Visible characteristics 103 may be appear on print-out cards or stickers. The images on the cards that are decorative and not part of visible characteristics 103 may include for example ABC letters, animals, shapes, characters or other suitable figures and the visible characteristics 103 may be placed on, near or around the other items that appear on the card. Visible characteristics 103 may also be printed on fabric, plastic, metal or any other suitable material. They may also be designed or customized by a user on a computer using software or on an Internet website or otherwise. For example, a user may design an image of an object 102 or a character or other figure and associate a code, a tag or label to that image. When printed, the visible characteristic 103 on the card may be recognized as the tag or label the user selected when designing it.

Returning to the example of the car and the stop sign described in FIG. 1 above, in one embodiment, an imager 105 may be included inside the headlight of the toy car or other self navigating vehicle. The imager 105 may recognize objects 102 having visible characteristics 103 in its environment or field of view, and react in some way to instructions associated with such objects 102. For example, a set of objects 102 that represents traffic signs may include a set of poles connected to a board that has a printed image of a traffic sign on top and a stand base at the bottom. The red sign with the words STOP in white may be used as a visible characteristic 103, and/or the pole may be covered by for example a unique repetitive linear color sequence to form a visible characteristic 103. In some embodiments, more than one visible characteristic may appear on a single object 102, and each such visible characteristic may be associated with a different instruction. For example, a color sequence on the visible characteristic 103 may represent a code that may be associated with a specific sign. Imager 105 may capture the image of the color sequence, and process the image to identity the sequence and associate the sequence with an instruction to stop. A second visible characteristic on the sign may be associated with a turn right instruction. The player may put the stop sign in the field of play and let the car self drive and behave according to the signs it sees on its way, such that a toy 104 car may approach the sign and stop, and then turn right.

Other objects 102 recognizable by the car may be for example include small models of pedestrians or pets or other objects, each having a recognized visible characteristic 103. In some embodiments, the car may recognize or detect another car or cars and follow or race with them.

In some embodiments, a toy 104 car having a housing 106 may be assume one of three or more modes, as follows:

1. Searching mode—the car may be driving in a field of play, for example in circles or in another pattern, with its imager 105 periodically capturing images in its field of view, and trying to detect recognized visible characteristics 103 in such images.
2. Navigating mode—once the toy car detects a traffic sign or visible characteristics 103 it starts to navigate toward it by sending commands to its motors to drive forward and commands to the steering motors to move the wheels to the left or to the right, depending on the location of the visible characteristics 103 relative to the center of the field of view of the imager 105. For example, an instruction may be to navigate the car until the visible characteristic 103 is in the center of the image at a pre-defined range or distance.
3. Perform instruction of traffic sign mode—once the distance between the car and the traffic sign is close enough for an accurate classification of the visible characteristic 103 on the traffic sign, the visible characteristic 103 may be decoded and the action associated with that instruction may be performed. For example, if the instruction on a sign or visible characteristics 103 is Turn Left, the car will send a command to its steering motor to turn left and will drive forward for a period of time which will make the car turn 90 degree from the course it was driving on when it saw the sign.

In the searching mode, an image may be analyzed as follows:

1. In some embodiments, a pole having a sticker with a visible characteristic 103 may be both vertically positioned and covered by a repetitive color sequence, and such position and sequence may be known in advance. A down-sampling of the image may be performed in a pyramid-like manner. The down-sampling may consist of taking each Nth pixel along the horizontal and vertical axis of the image. As this may be performed in several consecutive levels one of the down-sampled images will contain the color patches on the visible characteristics 103 on the pole as a series of single adjacent pixels.
2. A gradient operator may be performed on the down-sampled images. The gradient may be based on the subtraction of vertically adjacent pixels or on another analysis.
3. A threshold may be used to create a binary image of high levels in the gradient image.
4. A convolution operation may be performed that will count the number of adjacent high value vertical gradients. When such a number corresponds to the number of color patches on the pole, the image will be deemed to be a candidate for presence of a visible characteristic 103.
5. As the color sequence is repetitive, a similar measurement may be performed on the set of detected candidate pixels. If the similarity is high enough, a determination may be made of a high probability of the detection of the coded pole having a visible characteristic 103. If the similarity it is not high enough, the item captured in the image may be assumed to be a false detection.

In some embodiments, a key object, such as a patch of black color in the top of the pole or visible characteristics 103, may be used to verify that the set of pixels is indeed a color sequence. Other indicators may be added to an object 102 and may be used as preliminary indicators of the presence or location of a visible characteristic 103.

In the classification mode, where the car is close enough to the coded pole, the set of pixels found in the procedure of the search mode may be further analyzed for classification by color matching. The color patches on the pole may be printed or prepared in a few discriminative colors such as yellow, magenta, cyan and green or others. Each such color may represent a single code letter or other identifiable part of the visible characteristic 103. Processor 108 may compare the values of those pixels to stored values of the used colors in for example the hue saturation value (HSV) color space or in another more perceptual color space such as LAB, and may choose the closest match according to a distance metric such as Euclidean distance to classify the colors. Once all or some predefined threshold of pixels have been classified, a coding vector may be found, and an instruction associated with the coded vector may be identified. A set of commands may be sent to the motor to perform the desired associated instruction.

In another embodiment, a plush or other material doll may include a housing 106 that has or is connected to an embedded processor 108, imager 105 and a speaker or other output device 116. The imager 105 may use detection and recognition of pre-programmed objects 102, to recognize different pre-defined objects 102 or movements or positions of objects 102 or of a player or accessories that may be, include or be equipped with or wearing visible characteristics 103.

For example, visible characteristics 103 may be printed on cards that also have an image attached to them which may trigger a response from the doll or other toy 104 through audio, feedback, mechanical or other movements. The coded content or visible characteristics 103 may also be included in video content on a television screen or a computer screen, where the imager 105 inside the doll may be facing the screen with the content to capture an image of the items appearing on the screen. The coded content or visible characteristics 103 may be some wearable markers 130 on the player's wrists, legs and head where predefined body movements such as ducking, jumping, raising the hands etc., trigger responses from the doll. The coded content or visible characteristics 103 may take the form of other suitable objects 102 that have visual context such as paper cards, cardboard, plastic, broadcasted content, etc, targets on a dart board, areas on a punching bag or other sports, entertainment or physical training equipment or accessories.

In some embodiments, a play pattern may include answering questions in educational games, teaching basic concepts such as shapes, colors, letters, animals, etc. or even a physical game to teach body parts, body movement or monitor physical exercise, training procedures or physical therapy. For example, a doll including a housing 106 may be placed in front of a child wearing a bracelet with a visible characteristic 103, where the child is instructed to raise her hands and waive. Imager 105 may detect the visible characteristics 103 in the various positions in the series of captured images of the waiving child, and the processor 108 may determine compliance with an instruction to waive by measuring the change in position of the visible characteristics 103 in the series of images. Output devices 116 in the doll may have various audio or mechanical responses or feedbacks such as moving its hand, head, mouth, legs or other movements.

Visible characteristics 103 may be coded by using any suitable form of coding, such as repetitive color sequences on the boundaries of an object 102, a set of repetitive monochromatic shapes printed on object 102 or some texture pattern printed in two or more colors on an object 102. The recognition of visible characteristics 103 may be based on detection of the coded content in the image, decoding the code representation and associating the code with an instruction. The repetitions of the code or visible characteristics 103 on the object 102 may allow the imager 105 to overcome code occlusion by a user; therefore repetitions of the code may add robustness to the identification. In some embodiments codes may include a key or locators such as a colored bar, as an alignment bar for ease of identification.

Codes or visible characteristics 103 may be associated with a specific image or image sequences. By decoding the visible characteristics 103, the doll or toy may trigger the feedback which is associated with that image or image sequence. The coded content on some wearable markers 130 may be tracked and its motion analyzed in order to infer body position and movement and trigger the feedback which is associated with that movement or body position.

The code or visible characteristics 103 may be for example binary and may be read from right to left (in accordance to the position of the key or alignment bar) or in other orders of priority or hierarchies. In some examples a dark bit may be read as "1" while a light bit may be read as "0". An alignment bar and data bits may be colored with the same arbitrary color which may be darker or otherwise contrasted to with a background. A distance where this code is recognized in an image may be individual pixels. A code may also be a curved one as long as the proportions are maintained or otherwise accounted for in the image processing. Systems other than binary may be used.

In some embodiments a method of reading such a code may include the following:

- The edges of an image taken by a camera may be extracted from an imager.
- Edges forming closed contours may be identified.
- Corners of these closed contours may be extracted from the image for further analysis.
- The maximum distance (on the contour) between two adjacent corners may be identified as the alignment bar.
- The length of the alignment bar may be divided by the number of bits forming the code, revealing the number of pixels one or more bit contains.
- The intensity of the color code area may be read from the image by checking the value of a pixel in the middle or at another position of each bit of data.
- The intensity of a bit may be compared to the intensity outside the closed contour and inside it. If the intensity of a bit is closer to the intensity outside the closed contour than it may be identified as "0". Otherwise it may be identified as "1".
- The returned code may be the code with the maximum repetitions from all possible codes extracted from an image. For example, a circular visible characteristic may have a repeating pattern of the same code in the shape a circular frame around on object.
- The length of the alignment bar may be used to measure the distance of the code from the camera.

In another embodiment, an action, sports, music, dancing or exercise game may be played with costumes created from plastic, fabric or other material. The costumes may be designed to resemble some known character, an original character or as just plain wearable markers 130 serving as visible characteristics 103. The toy 104 may be a standalone article that may or may not have a screen or may be connected to a screen such as a television to show some animations or avatars representing a player wearing the costume. The toy may include an embedded processor 108 and may have an imager 105 to capture imagers and recognize and detect different movements and positions of the player wearing the costume.

A game may involve specific user motions, movements and body positions detection and recognition by detection, recognition, tracking and analysis of the pre-programmed accessories the player wears. The costume parts may be in one example, a hat or bandana or another object 102 that the player may hold on his hand. These costume parts may be designed in a way that will allow them to be easily detected and discriminated from the background of the captured scene. They may be coded in some form by using for example specific color texture patches arranged in some spatial grid.

Costumes may also be wings of a fairy or a dragon or an elephant's ears or other animal's body parts such as a dinosaur or superhero's features such as a helmet, special equipment held by those superheroes, or other items that have a visual context.

For example, a set of a plastic hook and fabric bandana may be used in a role play game where the user is playing a pirate. The player may wear the bandana on his head and hold the hook in his hand. Both these articles are coded by color patches or visible characteristics of for example a white and black on a red and blue background. The patches are arranged in a specific spatial arrangement which allows an algorithm to detect their presence in an image by segmenting the color image to color segments.

Once detected, the objects' locations in the image sequence are tracked by applying a tracking algorithm such as the Kalman Filter or other suitable filtering algorithm. The locations and movements of the objects represent the body positions and movement of the player and therefore can be used an indication for various such movements.

For example, if the bandana's position in an image sequence is tracked to a location which is lower than a previous location, this will imply a ducking action by the player. If the positions of both the bandana and hook are tracked to a location which is close to one another, this will imply that the player is putting his hand/hook on his head. In the same manner, different positions such as hand on head, hand to the side, hand on waist, ducking, jumping, moving from left to right can be recognized and affect the game state.

A toy 104 may give audio instructions to the player to move to a certain position or to perform a certain physical act. The 'Simon says' game, for example, can be played where the toy 104 asks the player to move to a position or to perform a physical move only when given an instruction precedes with the words 'Simon says'. The toy identifies correct and incorrect moves and positions, and triggers engaging audio and/or physical responses. Where applicable, an onscreen avatar may imitate actions performed by a player or may imitate those actions by an avatar in a timely manner. The same process may be applied to a dancing game where the player is wearing colorful markers and is supposed to imitate a sequence of body movements according to a representation on a screen. The detection, recognition and tracking of those markers and comparison in real-time to the desired body positions or motions will create a dancing game or may record a series of movements.

In another embodiment, a doll may imitate a player's movement or position by first recognizing the movement, and then mechanically imitating such movement. The recognition may be based on detection, recognition and tracking of pre-coded markers that the user places on his body, for example, a hat on his head and a wand in his hand. The doll then assumes a similar position by sending commands to motors to move his hands, legs or other body parts. The doll may also play a game with the user in which the user has to imitate the doll's actions.

In another embodiment, the detection and recognition of the pre-programmed accessories may be facilitated by a calibration procedure that prints and uses a calibration image. The calibration image may be printed using the same printer 120, as appears in FIG. 1, as is used for printing the props or visible characteristics 103. The calibration object may contain several color segments, that may be arranged in a form that will be easy to detect and recognize by the imager 105 and computer vision algorithms and that will allow it better detection, recognition and classification of colors for the different embodiments described above. The calibration of the imager processing with colors on the calibration prop or calibration object 107 may compensate for incorrect white balance settings, low dynamic range effects and color constancy problems in images that are captured from the field of play. For example, and returning to the stop sign in FIG. 1, in some embodiments, the red and white letters and colors on the stop sign may be used as a calibration object 107, while the visible characteristic 103 in the form of the sticker on the pole of the stop sign may include the visible code that is association with an instruction.

Figure 2:
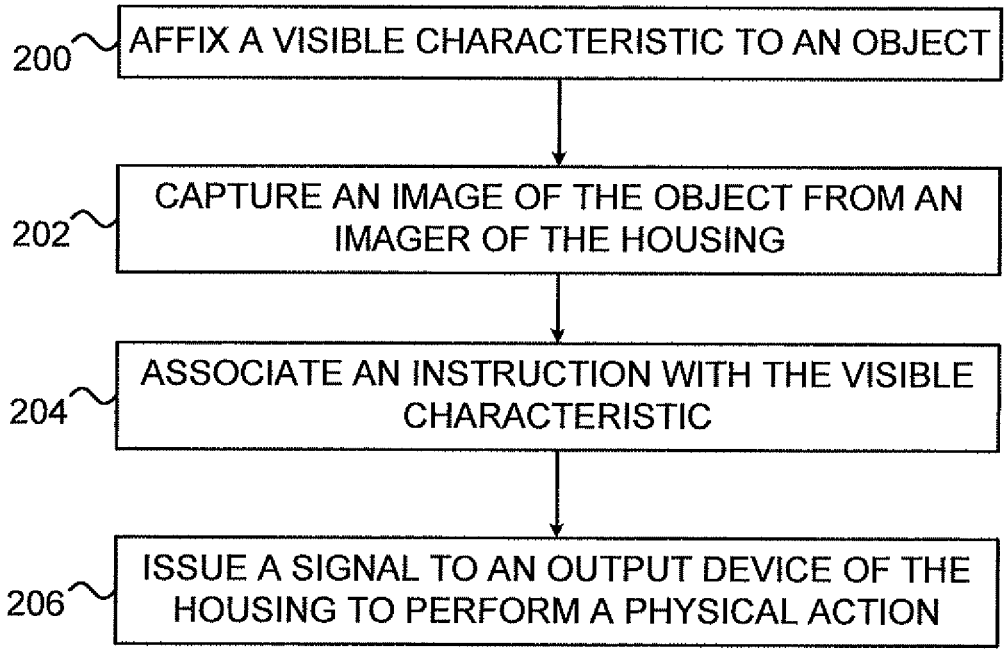
FIG. 2 is a flow diagram of a method in accordance with an embodiment of the invention.

Reference is made to FIG. 2, a flow diagram of a method in accordance with an embodiment of the invention. In block 200, a visible characteristic may be affixed or printed on an object. In some embodiments, the visible characteristic may be or include an inherent part of an object, such as the nose on a doll or a pattern on a costume. In block 202, an image may be captured of the object having the visible characteristic, where the image is captured by an imager in the housing of a toy. In block 204, an instruction may be associated with the visible characteristic. In block 206, when the visible characteristic is identified in an image and the relevant instruction is found, a signal may issue to an output device to perform a physical action in accordance with the instruction.

Other operations or series of operations may be used.

In some embodiments, the visible instruction may include altering a physical location of the housing, issuing a sound from a speaker or producing an image on a screen.

In some embodiments, a method may include issuing a signal to a receiver in or associated with the housing to alter an association of with the visible characteristic.

In some embodiments, a method may include printing the visible characteristic on a paper, and removably attaching the paper to an object.

Figure 4:
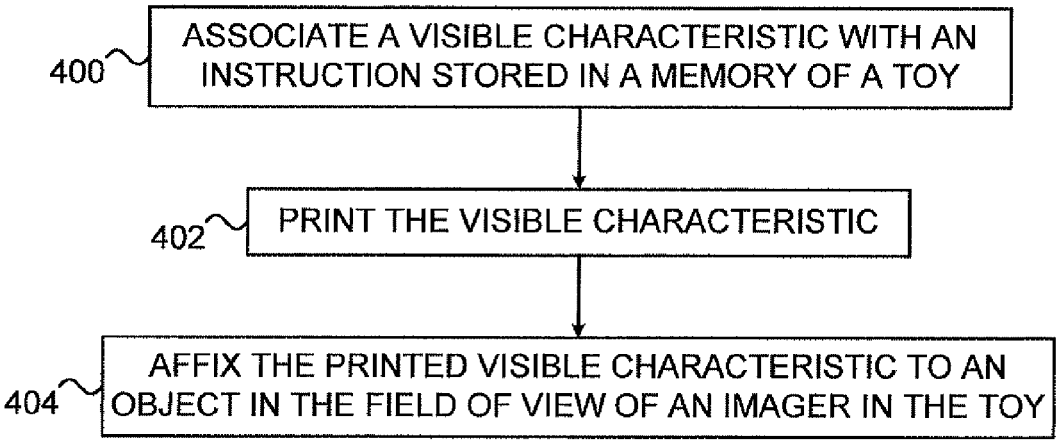
FIG. 4 is a flow diagram of a method in accordance with an embodiment of the invention.

Reference is made to FIG. 4, a flow diagram of a method in accordance with an embodiment of the invention. In block 400, a user may select or create a visible characteristic, and associate the visible characteristic with an instruction that is stored or that is to be stored in a memory of a toy. The instruction may for example be linked with commands or executable instructions to produce a signal to a motor or steering wheel of a toy car to alter a position of the car. In block 402, the user may print out the visible characteristic. In block 404, the user may affix the printed visible characteristic to an object that will be in the field of view of an imager in the toy.

In some embodiments, the user may alter the instruction that is associated with a particular visible characteristic by loading into a memory that is in the toy a change in the association of the instruction and the visible characteristic. In some embodiments, a series of visible characteristics may be printed and affixed to an object, and an imager that detects the series of visible characteristics may perform the series of instructions that are associated with the various visible characteristics.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

I claim:

1. A system for interactive toys comprising:

an object comprising:

a visible characteristic, said characteristic having a predefined association to a instruction from among a set of instructions; and a housing for a toy, said housing to hold:

an imager, said imager to capture an image, said image including said object;

a memory, said memory to store said instruction, said set of instructions and said association between said visible characteristic and said instruction;

an output device, said output device suitable to output a response associated with said instruction; and a processor, said processor to:

detect said object in said image;

identify in said memory said instruction associated with said visible characteristic; and issue a signal to said output device to output said response;

wherein said object is a wearable marker to be worn on a player, and wherein said image is a first image, and said imager is suitable to capture a second image of said object, and said processor is to measure a change in a position of said object between said first image and said second image.

2. The system as in claim 1, wherein said visible characteristic comprises a repeating pattern of said visible characteristic.

3. The system as in claim 1, wherein said output device is suitable to alter a location of said housing as said response associated with said instruction.

4. The system as in claim 1, wherein said output device is suitable to alter a position of an appendage of said housing as said response associated with said instruction.

5. The system as in claim 1, wherein said output device is suitable to make a sound in said response associated with said instruction.

6. The system as in claim 1, wherein said housing comprises a receiver suitable to accept a signal to alter said instruction associated with said visible characteristic.

7. The system as in claim 1, wherein said visible characteristic is removably attached to said object.

8. The system as in claim 1, wherein said housing includes a toy vehicle, said vehicle suitable to alter a locomotion direction in response to said instruction.

9. The system as in claim 1, wherein said visible characteristic is suitable to be printed and affixed to said object.

* * * * *